US006894618B2

(12) United States Patent
Rota et al.

(10) Patent No.: US 6,894,618 B2
(45) Date of Patent: May 17, 2005

(54) METHOD FOR MAINTAINING OSCILLATIONS OF A VIBRATING DEVICE AND VIBRATING DEVICE USING SAME

(75) Inventors: Sergio Rota, Neuchâtel (CH); Stéphane Künzi, Cormondrèche (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 47 days.

(21) Appl. No.: 10/433,058

(22) PCT Filed: Dec. 5, 2000

(86) PCT No.: PCT/CH00/00645

§ 371 (c)(1),
(2), (4) Date: May 30, 2003

(87) PCT Pub. No.: WO02/46847

PCT Pub. Date: Jun. 13, 2002

(65) Prior Publication Data

US 2004/0008105 A1 Jan. 15, 2004

(51) Int. Cl.[7] ..... G08B 23/00

(52) U.S. Cl. ..... 340/573.1; 340/540; 340/407.1; 340/825.19; 340/825.46

(58) Field of Search ..... 340/573.1, 573.4, 340/540, 825.19, 825.46, 407.1

(56) References Cited

U.S. PATENT DOCUMENTS

| | | | | |
|---|---|---|---|---|
| 5,436,622 A | | 7/1995 | Gutman et al. | |
| 5,559,761 A | * | 9/1996 | Frenkel et al. | 368/69 |
| 5,736,797 A | | 4/1998 | Motohashi et al. | |
| 5,955,799 A | | 9/1999 | Amaya et al. | |
| 6,211,775 B1 | * | 4/2001 | Lee et al. | 340/407.1 |
| 6,563,422 B1 | * | 5/2003 | Wiget et al. | 340/540 |

FOREIGN PATENT DOCUMENTS

| | | |
|---|---|---|
| DE | 198 59 622 A1 | 7/2000 |
| EP | 938 034 A1 | 8/1999 |

* cited by examiner

*Primary Examiner*—Hung Nguyen
(74) *Attorney, Agent, or Firm*—Sughrue Mion, PLLC

(57) ABSTRACT

There is disclosed a method for maintaining the oscillations of a vibrating device and a vibrating device implementing this method. The vibrating device is intended to be fitted to a unit worn close to the body, such as a timepiece, including a case, a moving mass inside this case intended to transmit vibrations thereto, a coil (L) electromagnetically coupled to said moving mass in order to make it vibrate, and an excitation circuit for exciting said coil CL). According to the method disclosed, driving pulses (21, 22) of alternate polarity and determined duration ($T_{pulse}$) substantially coinciding with the extrema of the movement induced voltage ($U_{ind}$, $V_{B12}$) across the terminals (B1, B2) of said coil (L) are generated.

11 Claims, 4 Drawing Sheets

METHOD FOR MAINTAINING OSCILLATIONS OF A VIBRATING DEVICE AND VIBRATING DEVICE USING SAME

TECHNICAL FIELD

The present invention relates generally to vibrating devices and other non-acoustic alarms intended to be fitted to a unit carried close to the body, such as a timepiece. More specifically, the present invention relates to a method for maintaining the oscillations of a vibrating device and a vibrating device implementing the same.

BACKGROUND OF THE INVENTION

In numerous situations, it is useful to be able to transmit information to a person other than by acoustic or visual means. This is the case particularly when one wishes to discreetly alert a person who is in the middle of a group of people. Tactile means for transmitting the information thus offer an advantageous alternative: a unit that the person is carrying close to the body, such as a watch, for example, is made to vibrate, in order to stimulate his skin locally to indicate to him a given time or the occurrence of an event (arrival of a message, a call, a meeting etc.). Such tactile information transmission means find application in a device for indicating to people, whose keenness of sight is reduced or non-existent, the time, the occurrence of an alarm or any other event. By way of information, reference can be made to European Patent Application Nos. EP 0 710 899 and EP 0 884 663, both also in the name of the Applicant, which disclose timepieces incorporating a vibrating device.

Unbalance type vibrating devices mounted on a rotor are known to those skilled in the art. In these devices, typically, the unbalance rotates at a speed of several tens of revolutions per second thanks to an electric motor powered at a power of several tens of milliwatts and started at the moment when the occurrence of an event has to be perceived by the wearer.

These devices have the main drawback of consuming a lot of energy, which is incompatible with the requirement to miniaturise batteries and components encountered in the horological field.

European Patent Application No. EP 0 625 738 in the name of the Applicant discloses a device for making a unit such as a watch vibrate. This device includes a coil electromagnetically coupled to a moving mass.

This Patent Application does not disclose the features of the coil excitation means. Having said this, those skilled in the art know that pulses whose frequency is equal to the natural mechanical oscillation frequency of the mass have to be applied to the coil in order to obtain maximum vibration amplitude for a given quantity of supplied energy.

However, in practice, this natural frequency is difficult to determine rigorously. First of all, it varies from one moving mass to another because of manufacturing tolerances, which are of the order of 15%. Then, it varies as a function of the way in which the coil-moving mass unit is carried, and the extent to which it is worn close to or remote from with the wearer's body. Typically, the carrying conditions induce variations of the order of 5% in the natural frequency of the unit, as well as a variation in the dissipated energy. These variations decrease the yield of the excitation means that are designed to operate at a fixed frequency, and this results in a significant waste of energy.

It is a general object of the present invention to overcome these drawbacks.

It will be noted that those skilled in the art already know, from U.S. Pat. No. 5,436,622, a vibrating device including a coil-moving mass unit which is activated, during a first phase, at a frequency substantially equal to a nominal natural oscillation frequency of the moving mass, then, during a second phase, is left in free oscillation in order to determine the natural oscillation frequency of the unit, which depends on the conditions in which the device is worn by the user. Once the natural oscillation frequency has been determined, the moving mass is driven at this frequency for the entire remaining duration of the vibration.

According to this document, it will be noted that the vibrating device is made to vibrate by a periodic rectangular signal of equal frequency to the determined natural frequency, for the entire period that the moving mass is made to vibrate. This appears clearly, for example, in FIG. 3 of U.S. Pat. No. 5,436,622. According to this document, the vibrating device is thus continuously driven and is never left in free oscillation during the period that the device vibrates.

Given that the natural oscillation frequency of the unit is dependent on the conditions of wear, this frequency can vary substantially during the period that the device vibrates. Thus, a major drawback of the device disclosed in the aforementioned U.S. Pat. No. 5,436,622, lies in the fact that it cannot respond to a modification in the natural oscillation frequency during vibration of the vibrating device, the measurement only being carried out when the device is next activated. The energetic yield of the device is thus not optimal, such that an alternative solution has to be sought. According to this U.S. Pat. No. 5,436,622, it is suggested in particular that the vibrating device be fitted with an additional sensor for measuring the oscillation frequency, as this appears in FIG. 5 of this document, in order to allow the oscillation frequency of the vibrating device to be adapted during the oscillation in progress.

European Patent Application No. EP 0 938 034 in the name of the Applicant discloses an advantageous solution according to which the natural oscillation frequency of the vibrating device is determined during each period (or half-period) of oscillation of the moving mass. Unlike the solution disclosed in the aforementioned U.S. Patent, this solution thus allows the variations in the natural resonating frequency to be taken into account when the device is made to vibrate, without it being necessary to use an additional sensor. Here, the device is driven in vibration, not by a periodic rectangular signal of determined frequency, but by a succession of positive and negative pulses generated during each half-period of oscillation at the end of time intervals that are a function of the instantaneous oscillation frequency of the moving mass measured during the preceding period. Between the driving pulses, the device oscillates freely such that measurement of the instantaneous natural frequency is possible.

The Applicant was able to observe that this solution could have a drawback in certain conditions. Without adequate control means, this solution can, in particular, be subjected to measuring errors which would result in driving the vibrator at an inadequate frequency. Indeed, in the event that a measuring error occurs, this measuring error is then repeated during the following oscillations, such that the device quickly becomes unstable. In order to avoid this risk, the device then has to be designed such that this instability is prevented.

One solution to this problem may consist in alternating the periods during which the natural oscillation frequency is measured and the periods during which oscillation of the vibrating device is maintained in order to let the latter vibrate freely and allow reliable measurement of the natural oscillation frequency. This solution is not, however, appropriate because of the rapid damping of the oscillations, which involves generating a driving pulse of greater intensity in order to maintain the oscillation of the unit and which consequently generates higher power consumption.

It is thus another object of the present invention to propose an alternative solution to that disclosed particularly in European Patent document No. EP 0 938 034 which allows an adequate response to be made to variations in the natural oscillation frequency of the device and which remains easy to implement.

It is also an object of the present invention to propose a solution that is more robust and more stable than the solutions of the prior art.

SUMMARY OF THE INVENTION

The present invention thus concerns a method for driving a vibrating device intended to be fitted to a unit carried close to the body in accordance with the features of the independent claim 1.

Advantageous implementations of this method form the subject of the dependent claims.

The present invention also concerns a vibrating device intended to be fitted to a unit carried close to the body in accordance with the features of the independent claim 4.

Advantageous embodiments of this vibrating device form the subject of the dependent claims.

According to the invention, the natural resonance frequency of the vibrating device is thus determined once and for all at the beginning of its activation. The driving pulses are generated at the end of a determined and non-variable interval of time that is in particular dependent on the measurement carried out at the beginning of activation and which is considered from the moment when the movement induced voltage generated across the coil terminals crosses its mean level. This non variable time interval can be predetermined and does not necessarily require a preliminary measurement of the natural oscillation frequency of the device. Thus, although the interval of time between the crossing of the mean level of the movement induced voltage and the generation of the following driving pulse is fixed, an adaptation of the frequency at which the driving pulses are generated is nonetheless carried out because the time taken by the induced voltage to reach its mean level after generation of a driving pulse is a function of the instantaneous natural oscillation frequency. It will be noted that the movement induced voltage is the image of the velocity of the moving mass whose oscillation frequency corresponds to the natural mechanical oscillation frequency of the moving mass.

Furthermore, this solution is more robust than the solution recommended in the aforementioned European Patent document No. EP 0 938 034, in the sense that the device is not sensitive to an error in the measurement of the natural frequency during the preceding period of oscillation, which error can generate instability in the device. Indeed, the natural oscillation frequency is measured once and for all when the device starts to vibrate and this natural oscillation frequency determines the time interval starting from the moment when the movement induced voltage crosses its mean level and at the end of which the driving pulse is to be generated.

According to the present invention, it will be understood that a compromise is thus achieved. Indeed, although the natural oscillation frequency is measured once and for all when the device starts to vibrate, frequency variations due to variable conditions of wear are nonetheless taken into account, to a certain extent, because of the fact that each driving pulse is generated at the end of a determined time interval considered from the moment when the movement induced voltage generated across the coil terminals crosses its mean level. There is thus an intimate relationship between the induced voltage generated across the coil terminals and the generation of the driving pulses. The driving pulses will occur slightly earlier or later depending on the conditions of wear, but will not occur in any event at inappropriate moments able to generate instability in the system.

BRIEF DESCRIPTION OF THE DRAWINGS

Other features and advantages of the present invention will appear more clearly upon reading the following detailed description, given with reference to the annexed drawings, given by way of non-limiting example and in which.

DESCRIPTION OF THE PREFERRED EMBODIMENTS

In a preferred embodiment, the device according to the invention includes similar structure members to those disclosed in the aforementioned European Patent Application EP 0 625 738. It thus includes a case (not shown), a moving mass (not shown) inside the case intended to transmit vibrations thereto and a coil electromagnetically coupled to the moving mass.

Figure 1:
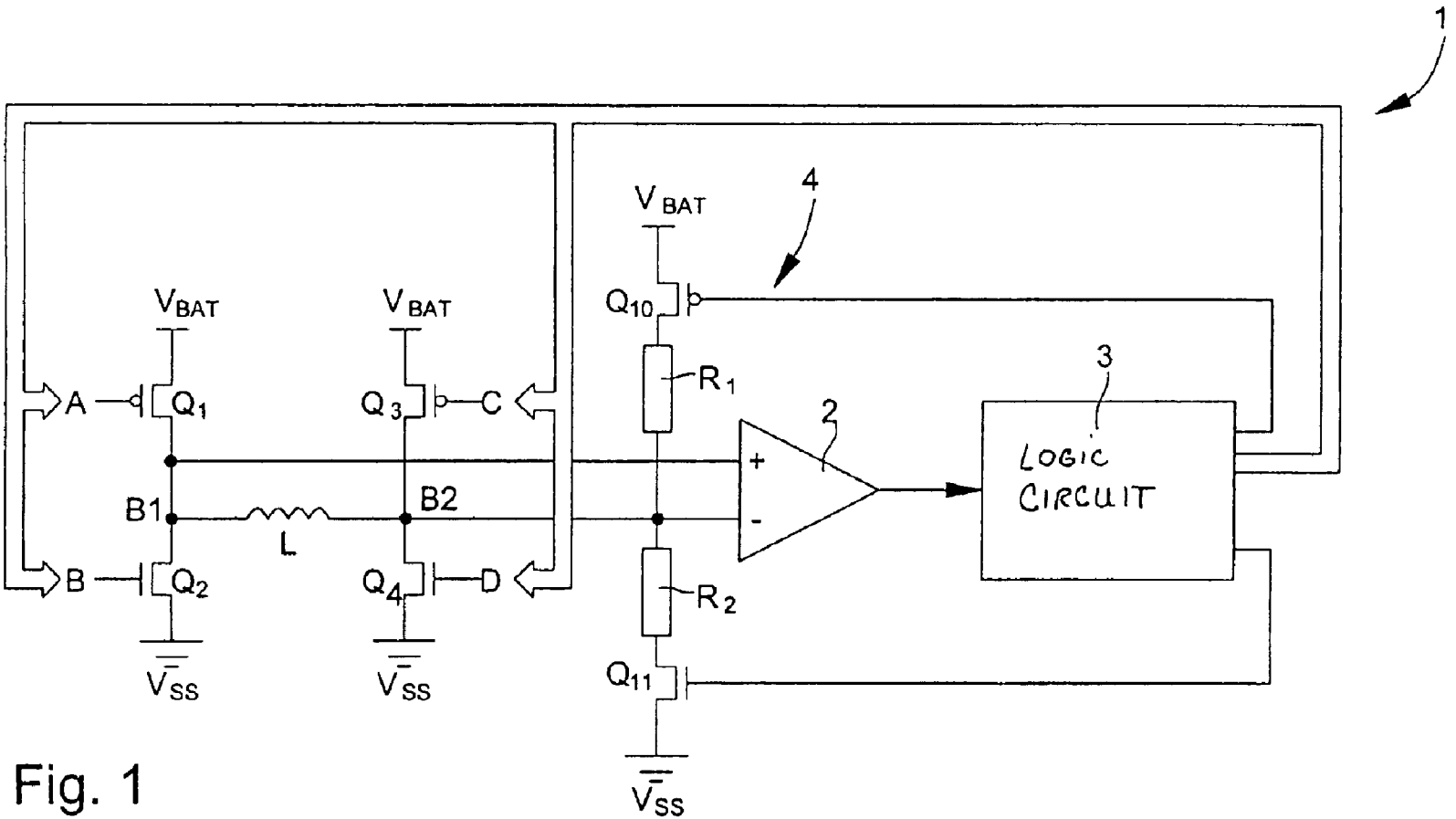
FIG. 1 shows a block diagram of a driving circuit of the vibrating device implementing the driving method according to the present invention.

This coil is schematically shown in FIG. 1 and is indicated by the reference L. Its first B1 and second B2 terminals are capable of being set to a zero voltage (ground $V_{ss}$) or to a voltage $V_{BAT}$ depending on the state of four transistors Q1, Q2, Q3, Q4.

The four transistors Q1, Q2, Q3 and Q4 form an H bridge for controlling the vibrating device in bipolar mode. The H bridge thus includes a first and a second branch including transistors Q1 and Q2, respectively transistors Q3 and Q4, series mounted between voltages $V_{BAT}$ and $V_{ss}$. More specifically, transistors Q1 and Q3 are p type MOS transistors, and transistors Q2 and Q4 are n type MOS transistors. As can be seen in FIG. 1, the first terminal B1 of the coil is connected to the connection node of transistors Q1 and Q2, and the second terminal B2 to the connection node of transistors Q3 and Q4.

The gates of transistors Q1, Q2, Q3 and Q4 are respectively controlled by signals A, B, C and D produced by a logic circuit 3. As a function of control signals A, B, C and D, transistors Q1, Q2, Q3 and Q4 and coil L occupy the states indicated by the following truth table where the indications "NC" and "C" respectively mean that the transistor being considered is in the non-conductive or conductive state:

| A | B | C | D | Q1 | Q2 | Q3 | Q4 | Coil L |
|---|---|---|---|---|---|---|---|---|
| 1 | 0 | 1 | 0 | NC | NC | NC | NC | High impedance |
| 0 | 0 | 1 | 1 | C | NC | NC | C | B1 = $V_{BAT}$ ; B2 = $V_{SS}$ |
| 1 | 1 | 0 | 0 | NC | C | C | NC | B1 = $V_{SS}$ ; B2 = $V_{BAT}$ |
| 0 | 0 | 0 | 0 | C | NC | C | NC | Short circuit |

The first and second terminals B1, B2 of coil L are also respectively connected to the non-inverting (positive terminal) and inverting (negative terminal) terminals of a comparator 2 formed of a differential amplifier responsible for amplifying and returning at output the movement induced voltage $U_{ind}$ measured across terminals B1, B2 of coil L. This movement induced voltage $U_{ind}$ is applied to the input of logic circuit 3 responsible, on the one hand, for generating the control signals A, B, C, D necessary for transistors Q1, Q2, Q3 and Q4 of the H bridge to ensure the generation of the starting pulses and vibration driving pulses of the vibrating device, and, on the other hand, for measuring the frequency of induced voltage $U_{ind}$ derived from comparator 2.

We shall not dwell any further on the making of logic circuit 3. Those skilled in the art can refer to the aforementioned European Patent Application No. EP 0 938 034, which is incorporated herein by reference, to obtain the information necessary to enable them to make the device according to the present invention in practice, on the basis of the indications that are provided hereinafter.

As illustrated in FIG. 1, the device further advantageously includes a voltage divider able to be switched on, globally designated by the numerical reference 4 responsible for imposing a determined voltage at the Inverting input (negative input) of comparator 2. This voltage divider 4, here in the form of a resistive divider, forms a means for fixing the negative input of comparator 2 at a determined potential, only when the movement induced voltage $U_{ind}$ is observed, i.e. between two successive driving pulses, when coil L is in the high impedance state (Q1, Q2, Q3, Q4 in the non-conductive state). This resistive divider is switched off in the other phases.

More specifically, the resistive divider 4 including a series arrangement between voltages $V_{BAT}$ and $V_{ss}$ of a first transistor Q10 (p type MOS transistor), of first and second resistors $R_1$, $R_2$, and of a second transistor Q11 (n type MOS transistor). The connection node between resistors $R_1$ and $R_2$ is connected to the inverting input of comparator 2 and the gates of transistors Q10 and Q11 are connected to logic circuit 3.

In this embodiment example, one chooses for example to fix the potential of the inverting terminal of comparator 2 at a voltage equal to $V_{BAT}/2$ using resistors $R_1$ and $R_2$ of substantially equal value to do this. When coil L is at the high impedance state, i.e. when transistors Q1, Q2, Q3 and Q4 of the H bridge are all at the non-conductive state, resistive divider 4 is then switched on by activating transistors Q10 and Q11 and a voltage substantially equal to $V_{BAT}/2$ is applied to the inverting input of comparator 2. Consequently, the mean value of the induced voltage is fixed at this level $V_{BAT}/2$.

The level $V_{BAT}/2$ will be used particularly by logic circuit 3 for the purpose of detecting moments in time starting from which the driving pulses have to be generated. By referencing the movement induced voltage $U_{ind}$ with respect to level $V_{BAT}/2$, one also ensures that movement induced voltage $U_{ind}$ is always positive, its peak to peak amplitude being less than voltage $V_{BAT}$. In the embodiment example that is described in the present Application, it will be understood that movement induced voltage $U_{ind}$ is sampled at a determined frequency. By fixing the mean value of movement induced voltage $U_{ind}$ at this level $V_{BAT}/2$, all the signal samples are thus positive.

It will easily be understood that the use of the resistive divider is not strictly necessary. It will also be understood that a different mean level from $V_{BAT}/2$ could be fixed by resistive divider 4. The example that is presented here is particularly advantageous insofar as it is desirable to process the signal generated at the comparator output in a digital manner.

Figure 2:
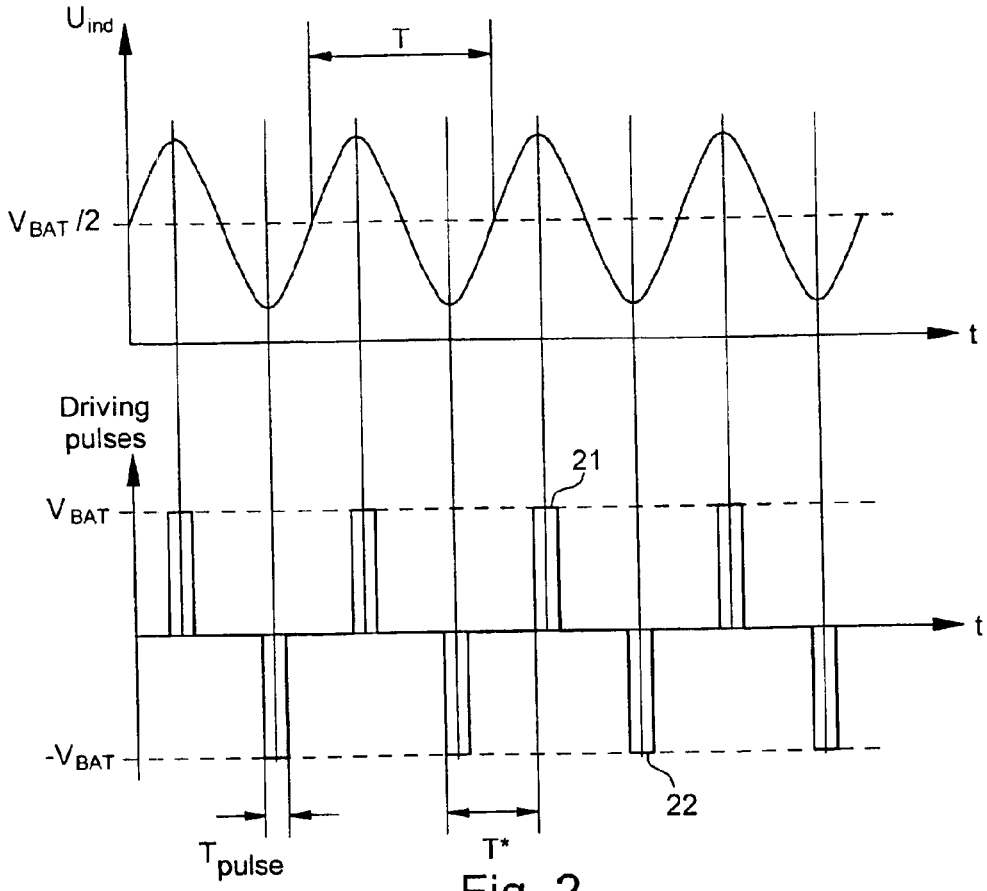
FIG. 2 shows a diagram of the evolution over time of the movement induced voltage $U_{ind}$ across the coil terminals and a diagram illustrating the shape of the driving pulses generated over time.

FIG. 2 shows schematically two diagrams, respectively, of movement induced voltage $U_{ind}$ and the shape of the driving pulses generated over time. As mentioned hereinbefore, the mean value of movement induced voltage $U_{ind}$ is fixed at level $V_{BAT}/2$. This induced voltage has a period T (or in other words a frequency f), which is partly determined by the conditions of wear of the object in which the vibrating device is incorporated. The frequency f of this signal essentially corresponds to the mechanical resonance frequency of the vibrating device.

As can be seen in FIG. 2, the driving pulses are generated in phase with the movement induced voltage. Driving pulses of positive and negative polarity 21, 22 thus follow each other alternately over time. More specifically, the driving pulses are substantially generated in phase with the extrema of movement induced voltage $U_{ind}$. From the energy point of view, it is in fact preferable to generate these driving pulses when the movement amplitude of the moving mass is zero, i.e. when the amplitude of movement induced voltage $U_{ind}$ is maximal. It will easily be understood that the energy balance is considerably worse if the driving pulses are generated at other times. It will thus be understood that there is an intimate relationship between movement induced voltage $U_{ind}$ and the generation of driving pulses.

With reference to the diagram of FIG. 2 illustrating the shape of the driving pulses, it will be noted that time interval T* that separates two successive driving pulses will substantially determine the frequency at which the vibrating device is driven. The width of pulses $T_{pulse}$ determines the intensity of the vibration generated. It will easily be understood that the wider the pulses, the higher the intensity of the vibration. As will easily be understood, the width of the pulses is however limited so as to allow free oscillation of the unit between two successive driving pulses and to allow the vibration frequency to be adapted during operation of the vibrating device.

Within the scope of the present invention, it will be noted first of all that the time interval T* between two successive driving pulses is adapted to the instantaneous oscillation frequency of the unit which arises from the shape of movement induced voltage $U_{ind}$. It should be specified again that the device disclosed in the aforementioned European Patent Application No. EP 0 938 034 operates on a similar principle but different however in the sense that the time interval between two successive pulses is, according to this European Application, exactly adjusted to the period of oscillation measured from movement induced voltage $U_{ind}$ during the preceding period (or half-period) of oscillation. According to this European Application, the time interval T* between two successive driving pulses substantially corresponds to the half-period of oscillation of movement induced voltage $U_{ind}$ measured during the preceding period.

Conversely, within the scope of the present invention, the measurement is carried out once and for all when the device is made to vibrate, such that the time interval T* separating two successive driving pulses will not be exactly adjusted to the instantaneous period of oscillation of the device. By extension, this measurement is not, a priori, necessary and the time parameters defining when the driving pulses have to be generated can be fixed beforehand on the basis of a typical or nominal oscillation.

According to the present invention, as will be seen clearly hereinafter, this time interval T* varies nonetheless as a function of the instantaneous oscillation frequency without it being necessary to carry out an exact measurement of this frequency during each oscillation. Consequently potential problems linked to an error in measurement of the instantaneous oscillation frequency are avoided, given that this measurement is only carried out once when the vibrating device is started or is determined beforehand, such problems being able to arise with a vibrating device operating on the basis of the principle disclosed in the aforementioned European Patent Application No. EP 0 938 034.

Figure 3:
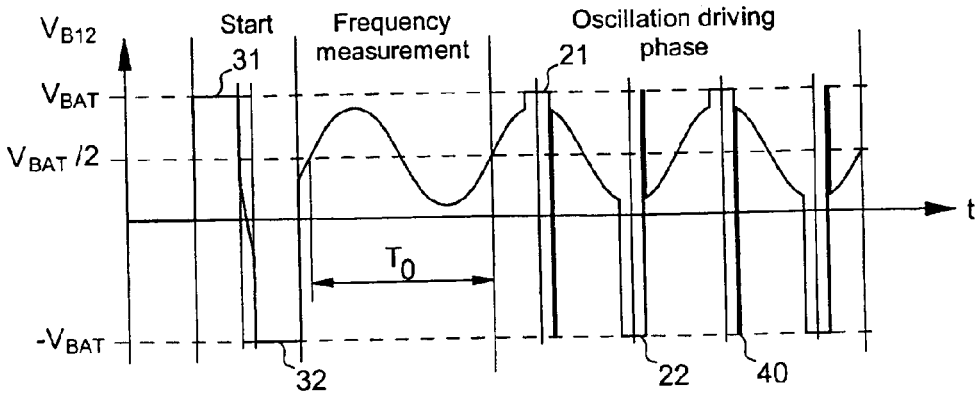
FIG. 3 shows a diagram illustrating the various phases carried out over time when the vibrating device is switched on in accordance with the implementation of the present invention.

FIG. 3 illustrates schematically the starting of the vibrating device according to the implementation of the present invention. More specifically, FIG. 3 shows a diagram of the evolution of voltage $V_{B12}$ across the terminals of coil L over time at the moment that the vibrating device is started. During a first phase, called the starting phase, two starting pulses 31, 32 of reverse polarity are successively generated so as to set the device into vibration.

This first phase is followed by a second phase, called the frequency measuring phase, during which the device is left in free oscillation. During this second phase, the device will tend to oscillate in accordance with its natural oscillation frequency hereinafter called the nominal oscillation frequency and referred to as reference $f_o$. This nominal frequency $f_o$ is for example measured by determining the period of oscillation $T_o$, called the nominal period of oscillation, of the movement induced voltage during this second phase on the basis of crossings of the movement induced voltage through the mean level. Alternatively, one could simply measure the half-period of oscillation of the signal. As already mentioned, this second measuring phase is not strictly necessary since nominal period $T_o$ can be fixed beforehand.

Once nominal period $T_o$ has been fixed or determined, the device enters a third phase, called the driving phase, which extends until the end of the vibration of the device. During this third phase, driving pulses 21, 22 of alternate polarity, substantially in phase with the extrema of the movement induced voltage, are generated in accordance with the principle that was presented with reference to FIG. 2.

During the driving phase, at the end of each driving pulse applied to coil L of the vibrating device, it will be noted that the simultaneous blockage of the four transistors Q1, Q2, Q3 and Q4 of the H bridge results in the appearance of an overvoltage of opposite polarity, designated 40, whose time constant is dependent upon the characteristics of coil L, particularly its electrical resistance and inductance. We will return subsequently to the question of these overvoltages.

Figure 4A:
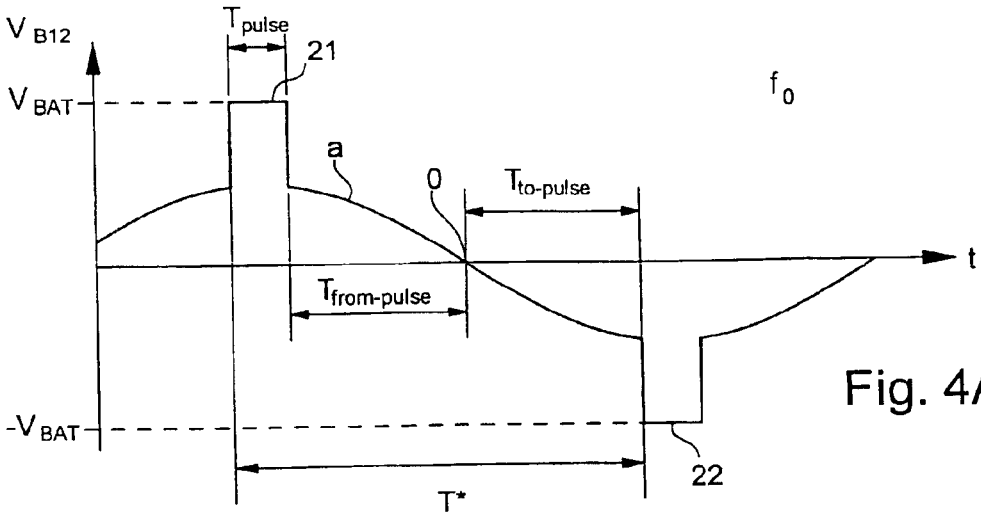
FIGS. 4A to 4C respectively show first, second and third diagrams of the evolution over time of voltage $V_{B12}$ present across the coil terminals for frequencies respectively equal to, greater than and lower than a nominal oscillation frequency $f_o$.
Figure 4B:
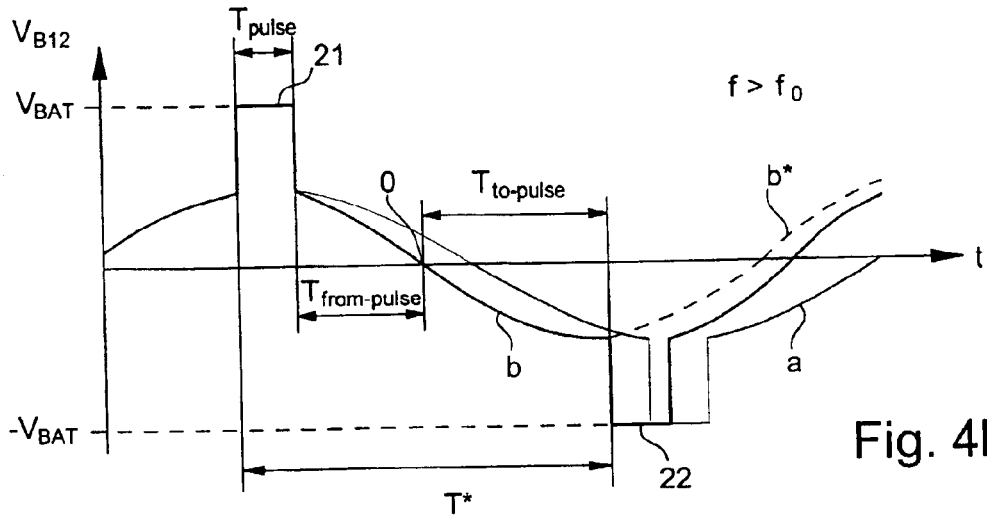
Figure 4C:
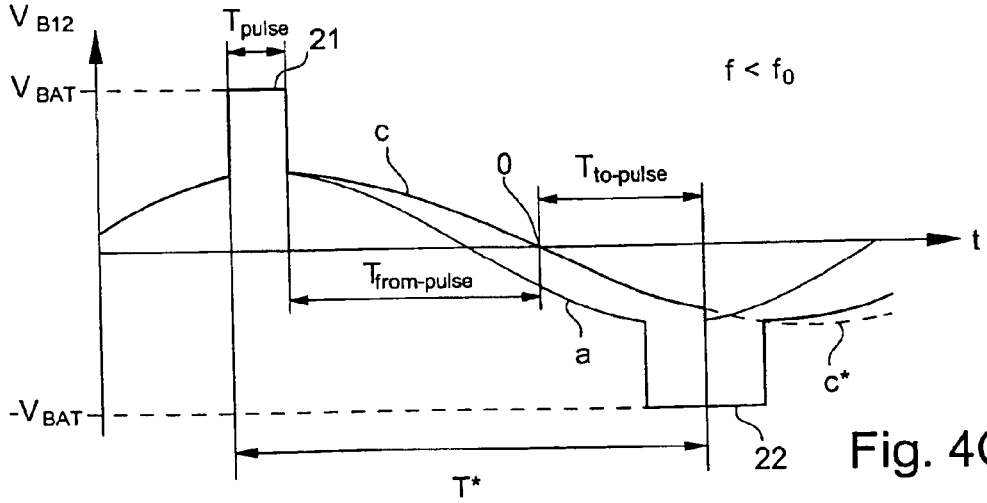

With reference to FIGS. 4A to 4C, the driving principle of the vibrating device according to the present invention will now be described in detail. For the sake of simplification, it will be noted that the overvoltages that have just been mentioned have not been shown in these figures. Also for the sake of simplification, voltage $B_{12}$ across the coil terminals has been shown as having a zero mean value and not a mean value equal to $V_{BAT}/2$ imposed by resistive divider 4. In principle, this basically does not change anything.

FIGS. 4A, 4B and 4C each show the evolution, over time, of voltage $VB_{12}$ across the terminals of coil L during the driving phase, i.e. the third and last phase illustrated in FIG. 3. More specifically, FIG. 4A shows the evolution, indicated by curve a, of voltage $V_{B12}$ in a case in which the natural oscillation frequency of the vibrating device substantially corresponds to the nominal frequency $f_o$ which was that of the vibrating device during the frequency measuring phase (second phase in FIG. 3), i.e. in a situation in which the natural oscillation frequency of the vibrating device would not have been modified by the conditions in which it is worn by the user.

In this case, given that there is not any modification in the frequency, the duration T* separating two successive driving pulses 21, 22 is substantially equal to half of the measured or fixed nominal period $T_o$, i.e. $T_o/2$, and the vibrating device is thus driven at a substantially equal frequency to the measured nominal frequency $f_o$.

According to the present invention, each driving pulse, whether it is of positive or negative polarity, is generated at the end of a determined time interval, designated $T_{to\text{-}pulse}$, which is considered from the mean level crossing of voltage $V_{B12}$, which is indicated by the reference O in the figures (in this case, it is a zero crossing of voltage $V_{B12}$). This time interval $T_{to\text{-}pulse}$ is fixed once and for all by determination of nominal period $T_o$. More specifically, this time interval $T_{to\text{-}pulse}$ has a value of a quarter of nominal period $T_o$ from which one subtracts half of pulse width $T_{pulse}$, i.e.:

$$T_{to\text{-}pulse}=T_o/4-T_{pulse}/2 \quad (1)$$

It will be understood that time interval T* separating two successive driving pulses 21, 22 is partly determined by the time interval $T_{to\text{-}pulse}$. Time interval T* is further determined by the time taken by the moving mass to return to its median (or rest) position with respect to the coil, i.e., in other words, the time taken by the movement induced voltage to drop to an amplitude (with respect to its mean value) which is zero. In the figures, this time is indicated by the reference $T_{from\text{-}pulse}$. Consequently, it will be understood that the time interval T* between two pulses is dependent on two factors, one being a determined and non-variable time interval, $T_{to\text{-}pulse}$, and the other being a variable time interval, $T_{from\text{-}pulse}$, depending on the conditions in which the vibrating device is worn.

According to the present invention, it will thus be noted that, although the frequency measurement only occurs once the vibrating device is started (or is alternatively fixed beforehand), the frequency at which the driving pulses are generated nonetheless vary as a function of the instantaneous oscillation frequency of the vibrating device. This will appear clearly from the discussion of FIGS. 4B and 4C.

FIG. 4B illustrates another case in which a variation in the conditions in which the vibrating device is worn has lead to an increase in the oscillation frequency with respect to nominal frequency $f_o$. This results in a modification in the movement induced voltage frequency and thus in the voltage $V_{B12}$ across the coil terminals. This modification is schematically illustrated by curve b in FIG. 4B. By way of comparison, curve a of FIG. 4A is also illustrated in FIG. 4B.

In the situation illustrated in FIG. 4B, it will thus be understood that the time $T_{from\text{-}pulse}$ taken by the movement induced voltage to drop to a zero amplitude with respect to its mean value is consequently reduced with respect to the situation illustrated in FIG. 4A. Since time interval $T_{to\text{-}pulse}$ at the end of which the next driving pulse is generated, remains fixed, the driving pulse (22 in the figure) is applied with a slight phase error (lag) with respect to the extrema of the movement induced voltage as can be seen by comparing the position in time of driving pulse 22 with respect to curve b* which illustrates the evolution of the movement induced voltage in the event that no pulse is generated. From the energy point of view, it will be observed, nonetheless, that the energy balance is better than in the case where the driving pulses are generated periodically at fixed time intervals as in the solutions of the prior art.

FIG. 4C illustrates the opposite case in which a variation in the conditions in which the vibrating device is worn has lead to a reduction in the oscillation frequency with respect to nominal frequency $f_o$. This also results in a modification in the movement induced voltage frequency and thus in voltage $V_{B12}$ across the terminals of the coil which is schematically illustrated by curve c in FIG. 4C. By way of comparison, curve a of FIG. 4A is also illustrated in FIG. 4C.

In the situation illustrated in FIG. 4C, it will thus be understood that the time $T_{from\text{-}pulse}$ taken by the movement induced voltage to drop to a zero amplitude with respect to its mean value is consequently longer with respect to the situation illustrated in FIG. 4A. Since time interval $T_{to\text{-}pulse}$ at the end of which the next driving pulse is generated, remains fixed, the driving pulse (22 in the figure) is applied with a slight phase error (lead) with respect to the extrema of the movement induced voltage as can be seen by comparing the position in time of driving pulse 22 with respect to curve c* which illustrates the evolution of the movement induced voltage in the event that no pulse is generated. The energy balance, in this case also, is better than in the case where the driving pulses are generated periodically at fixed time intervals as in the solutions of the prior art.

If one compares the driving principle according to the present invention to the driving principle disclosed in the aforementioned European Patent Application No. EP 0 938 034, it will be understood that the solution according to the present invention is slightly less optimum from an energy point of view. Nonetheless, the solution according to the present invention is more robust and more stable in the sense that there is no risk of the vibrating device being driven at an erroneous frequency with respect to its real natural oscillation frequency and of the device consequently becoming unstable, which might arise with a vibrating device operating in accordance with the aforementioned European Patent Application.

The particular interest of the present invention with respect to the other solutions of the prior art, and particularly those solutions consisting in driving the vibrating device at a fixed frequency, lies in the fact that the frequency at which the driving pulses are generated varies as a function of the conditions in which the vibrating device is worn by the user.

We should return to the question of the occurrence of overvoltages during interruption of each driving pulse. The time constant of these overvoltages is essentially determined by the characteristics of the coil, and particularly its electrical resistance and inductance. The appearance of each overvoltage leads to two successive crossings, relatively close in time, of voltage $V_{B12}$ by its mean value. These overvoltages should thus preferably be filtered by adequate means, either at the input of comparator 2 by appropriate analog filtering means, or at the output of comparator 2 by a digital filtering means, in order to prevent these mean value crossings due to overvoltage being detected as the desired mean value crossings, i.e. the specific moments which determine the time of generation of driving pulses.

In addition to the analog solution, one solution consists for example in inhibiting comparator 2 during a determined time interval after interruption of the driving pulse, such time interval being selected to be greater than the time during which the overvoltage is produced.

Figure 5:
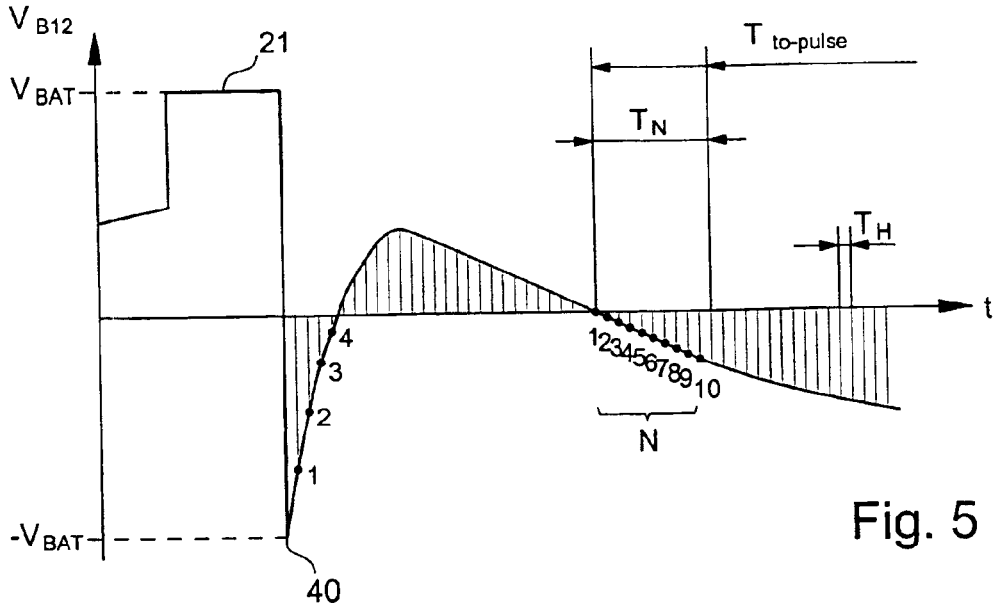
FIG. 5 illustrates an implementation example of a principle allowing overvoltages appearing at the end of each driving pulse to be filtered.

According to another solution, in order to carry out "digital filtering" of the overvoltages, several successive samples of the signal produced at the output of comparator 2 should advantageously be examined. FIG. 5 schematically illustrates voltage $V_{B12}$ present across the coil terminals and overvoltage 40 appearing at the end of the generation of driving pulse 2. As schematically illustrated, the signal is sampled at regular intervals designated TH such that a series of signal samples is produced. It will be noted that the scale and the number of samples is presented here solely by way of example.

More particularly, at the moment of overvoltage 40, four samples whose value is less than the mean level of the movement induced voltage, are produced. These four samples are designated by the references 1 to 4. The sample following the fourth sample is higher than the mean level of the movement induced voltage. Following the mean level crossing of the movement induced voltage, indicated by the reference O, more than ten samples whose value is less than the mean value of the movement induced voltage are generated. By way of example, the first ten samples have been indicated by the references 1 to 10. The situation is reversed in the case in which one examines an overvoltage produced at the end of a driving pulse of negative polarity.

Thus, by examining a number N of successive samples (for example ten in the schematic example of FIG. 5) and checking that these ten successive samples all have a lower value (or higher in the opposite case) than the mean level of the movement induced voltage (in the example this mean level is zero), an overvoltage can be clearly distinguished from a normal mean level crossing. One should thus choose a number N of samples higher than the number of samples of value inferior to the mean level produced following an overvoltage. One should also consider the delay caused during determination of mean level crossing O, i.e. delay $T_N$ whose value is equal to N times sample period $T_H$, and subtract this delay from time $T_{to\text{-}pulse}$, until generation of the next driving pulse defined in the expression (1) hereinbefore, as is schematically illustrated in FIG. 5.

It will be understood that various modifications and/or improvements obvious to those skilled in the art can be made to the driving method and to the vibrating device described in the present description without departing from the scope of the invention defined by the annexed claims. In particular, it will be recalled that it is not a priori necessary to carry out a prior measurement of the oscillation frequency of the vibrating device and that the time parameters defining when the driving pulses have to be generated, namely particularly time interval $T_{to\text{-}pulse}$ can be predetermined and fixed to a nominal value. The prior measurement is nonetheless preferable in the sense that one optimises the operation of the vibrating device by being as close as possible to the natural frequency of the vibrating device at the moment when it is activated.

What is claimed is:

1. A method for maintaining the oscillations of a vibrating device intended to be fitted to a unit worn close to the body, for use in a timepiece, including a case, a moving mass inside said case intended to transmit vibrations thereto, a coil electromagnetically coupled to said moving mass in order to make it oscillate, and an excitation circuit for exciting said coil, said method consisting in generating, by means of said excitation circuit, a set of driving pulses of alternate polarity and of determined duration substantially coinciding with extremes of movement induced voltage produced across terminals of said coil, wherein each driving pulse is generated at the end of a determined and non-variable time interval considered from a mean level crossing of said movement induced voltage, the time interval taken by said movement induced voltage to reach said mean level crossing at the end of a driving pulse being determined by the instantaneous natural oscillation frequency of the vibrating device, such that an adaptation of the frequency at which said driving pulses are generated is carried out.

2. The method according to claim 1, wherein, when said vibrating device is activated or following an abrupt disturbance to said unit worn close to the body, at least one starting pulse is generated to cause said vibrating device to oscillate.

3. The method according to claim 2, wherein, following forced oscillation of said vibrating device, a natural oscillation frequency measurement is carried out so as to fix said non-variable time interval at the end of which each driving pulse is generated from said mean level crossing of the movement induced voltage.

4. A vibrating device intended to be fitted to a unit worn close to the body, for use in a timepiece, including a case, a moving mass inside said case intended to transmit vibrations thereto, a coil electromagnetically coupled to said moving mass in order to make it vibrate, and an excitation circuit for exciting said coil, said excitation circuit being arranged to produce a set of driving pulses of alternate polarity and of determined duration substantially coinciding with extremes of movement induced voltage produced across terminals of said coil, wherein said excitation coil is arranged to generate each driving pulse at the end of a determined and non-variable time interval considered from a mean level crossing of said movement induced voltage, the time interval taken by said movement induced voltage to reach said mean level crossing at the end of a driving pulse being determined by the instantaneous natural oscillation frequency of the vibrating device, such that an adaptation of the frequency at which said driving pulses are generated is carried out.

5. The device according to claim 4, wherein said excitation circuit includes:

an H bridge including first and second branches each including a pair of transistors series connected between two supply potentials, said coil being connected by its terminals between the connection nodes of the transistors of each branch;

a comparator including first and second inputs connected to the terminals of said coil and intended to amplify the voltage across the terminals of said coil; and a logic circuit particularly for controlling the state of the transistors of said H bridge so as to apply alternately a positive and negative voltage across the terminals of said coil in order to generate said driving pulses.

6. The device according to claim 5, wherein said logic circuit further allows at least one starting pulse to be generated, when said vibrating device is activated or following an abrupt disturbance to said unit worn close to the body, in order to make said vibrating device oscillate.

7. The device according to claim 6, wherein said logic circuit further allows a measurement of the natural oscillation frequency of the vibrating device so as to fix said non-variable time interval at an end of which each driving pulse is generated from said mean level crossing of the movement induced voltage.

8. The device according to claim 5, further including filtering means for filtering an overvoltage appearing at an end of the generation of each driving pulse.

9. The device according to claim 8, wherein a signal generated at an output of said comparator is sampled by said logic circuit and wherein said filtering means include means for examining a number N of successive samples of the signal, the number N being selected so as to allow a differentiation between said overvoltage and said mean level crossing of said movement induced voltage, a time interval equal to N times the sampling period being subtracted from said non-variable time interval.

10. The device according to claim 8, wherein said filtering means include means for inhibiting the output of said comparator during a determined time interval greater than the duration of said overvoltage.

11. The device according to claim 5, further including a voltage divider able to be switched on, for fixing the potential of one of the inputs of said comparator at a determined voltage between two successive driving pulses when the vibrating device is oscillating freely in order to fix the mean level of said movement induced voltage at this determined voltage.

* * * * *